US011717861B2

(12) United States Patent
Rudofski

(10) Patent No.: US 11,717,861 B2
(45) Date of Patent: Aug. 8, 2023

(54) APPARATUS AND METHOD FOR CLEANING

(71) Applicant: Adam Vincent Rudofski, La Grange, IL (US)

(72) Inventor: Adam Vincent Rudofski, La Grange, IL (US)

( * ) Notice: Subject to any disclaimer, the term of this patent is extended or adjusted under 35 U.S.C. 154(b) by 475 days.

(21) Appl. No.: 16/718,180

(22) Filed: Dec. 17, 2019

(65) Prior Publication Data

US 2020/0206784 A1 Jul. 2, 2020

Related U.S. Application Data

(60) Provisional application No. 62/917,633, filed on Dec. 18, 2018.

(51) Int. Cl.
*B08B 1/00* (2006.01)

(52) U.S. Cl.
CPC ..... *B08B 1/001* (2013.01)

(58) Field of Classification Search
CPC ..... B08B 1/001; B08B 1/006; A47L 13/16; A47L 13/38; A47L 13/42
See application file for complete search history.

(56) References Cited

U.S. PATENT DOCUMENTS 2,987,745 A * 6/1961 Ballinger ..... A47L 13/255 15/229.8
6,258,455 B1 7/2001 Clarke
8,931,115 B1 1/2015 Bonham
10,028,634 B1 7/2018 Calderon
11,045,064 B2 * 6/2021 Smeijer ..... A47L 13/20
2002/0152569 A1 * 10/2002 Zorzo ..... A47L 13/258 15/147.1
2004/0237240 A1 * 12/2004 Post ..... A47L 13/20 15/232
2005/0034260 A1 * 2/2005 Post ..... B25G 3/38 15/232
2005/0250404 A1 11/2005 Clarke
2006/0200929 A1 * 9/2006 Knopow ..... A47L 13/38 15/210.1
2006/0282969 A1 * 12/2006 Yamada ..... A47L 13/38 15/208
2007/0163304 A1 7/2007 Aloy Font
2008/0148508 A1 * 6/2008 Yamada ..... A47L 13/16 15/229.3
2012/0204900 A1 * 8/2012 Mckenzie ..... A47K 10/02 134/6
2013/0212822 A1 * 8/2013 Libman ..... A47L 13/44 29/428

(Continued)

FOREIGN PATENT DOCUMENTS

DE 4316890 A1 11/1994
WO 1994/024922 A1 11/1994

*Primary Examiner* — Alexander Markoff
(74) *Attorney, Agent, or Firm* — Kenneth J. Rudofski

(57) ABSTRACT

The apparatus and method of the present invention relate to a cleaning cloth, a cleaning cloth system, and a method for cleaning. The present invention contemplates a cleaning cloth that is adapted to operate together with a body to provide for an enhanced cleaning experience, and in at least certain embodiments provides an improved ability to more efficiently and effectively clean in tight spaces, such as for example within a relatively small opening between two adjacent structures.

20 Claims, 9 Drawing Sheets

(56) References Cited

U.S. PATENT DOCUMENTS

| | | | | |
|---|---|---|---|---|
| 2014/0007365 | A1* | 1/2014 | Salmon | A47L 13/20 15/143.1 |
| 2015/0351604 | A1* | 12/2015 | Li | A47L 13/38 15/209.1 |
| 2016/0114225 | A1* | 4/2016 | Brown | A63B 55/408 15/210.1 |
| 2016/0206172 | A1* | 7/2016 | Pullen | B08B 1/006 |
| 2018/0020897 | A1* | 1/2018 | Palmtag | B25G 1/04 134/6 |
| 2019/0045997 | A1* | 2/2019 | Damaschke | A47L 13/256 |
| 2019/0255403 | A1* | 8/2019 | Farina | A63B 57/60 |
| 2019/0321862 | A1* | 10/2019 | Moulton | B08B 1/00 |
| 2020/0085272 | A1* | 3/2020 | Pellegrino | A46B 5/0095 |

* cited by examiner

APPARATUS AND METHOD FOR CLEANING

CROSS-REFERENCE TO RELATED APPLICATION

This application claims priority to U.S. Provisional Patent Application Ser. No. 62/917,633, filed on Dec. 18, 2018, the entire contents of which is hereby incorporated by reference as if set forth fully herein.

BACKGROUND AND BRIEF SUMMARY OF INVENTION

The present invention relates in general to dusting and other forms of cleaning that are traditionally performed by hand using a cloth. More particularly, the invention relates to cleaning cloths and methods for using the same. Prior cleaning cloths and methods for using the same often present challenges when attempting to wipe or otherwise clean surfaces and areas that are not as open and accessible as compared to other kinds of surfaces and areas, or that are otherwise more difficult to clean through the use of prior art cleaning cloths and methods. Such surfaces and areas may include, for example and without limitation, surfaces at or near the bottom of a groove of a grooved surface, as well as surfaces adjacent narrow gaps between objects, like between keys of a keyboard, slots of an HVAC vent, or between a cabinet surround and an adjacent cabinet drawer face that is inset within the cabinet surround, just to name a few by way of example. The present invention makes various cleaning tasks easier to accomplish.

BRIEF DESCRIPTION OF THE FIGURES

The features and numerous advantages of the apparatus and method of the present invention will be apparent from a detailed description of example embodiments with reference to the Figures, in which:

FIG. 1(*b*) is a plan view of a first side of an example member, or body, that is at least primarily responsible for an increased rigidity of a corner portion of the first example embodiment shown in FIG. 1(*a*) relative to other portions of the first example embodiment of FIG. 1(*a*);

FIG. 1(*c*) is a plan view of a second, opposite side of the example member/body shown in FIG. 1(*b*);

FIG. 1(*d*) is another plan view of the first side of the first example embodiment shown in FIG. 1(*a*), with one corner portion of the example embodiment folded over onto a remaining portion of the example embodiment so as to reveal in part a second, opposite side of the first example embodiment;

FIG. 2(*b*) is another plan view of the first side of the second example embodiment shown in FIG. 2(*a*), with each of two opposing corner portions of the example embodiment respectively folded over onto a remaining portion of the example embodiment so as to reveal in part a second, opposing side of the second example embodiment;

FIG. 2(*c*) is another view of the second example embodiment shown in FIGS. 2(*a*) and 2(*b*), depicted mid-fold as the lower-left corner portion of the example embodiment shown for example in FIG. 2(*a*) is folded over, in the direction shown by the arrow in FIG. 2(*c*), onto the opposing upper-right corner portion of the example embodiment;

FIG. 2(*d*) is another view of the second example embodiment shown in FIGS. 2(*a*), 2(*b*) and 2(*c*), depicted in a substantially folded manner whereby one corner portion of the example embodiment is substantially folded over onto the opposing corner portion of the example embodiment;

FIG. 3(*b*) is a partial view of a fourth example embodiment of the present invention, depicting a corner portion having a pocket into which a member/body can be selectively and removably inserted so as to provide increased rigidity of the corner portion relative to other portions of the fourth example embodiment at which the member/body is not located;

FIG. 4(*b*) is an illustration of a close-up view of an upper right corner of the drawer and cabinet surround arrangement illustrated in FIG. 4(*a*);

FIG. 4(*c*) is a first front perspective view of a drawer and cabinet surround arrangement of the sort illustrated in FIG. 4(*a*), looking down into a partially open drawer within the drawer opening of the cabinet surround;

FIG. 4(*d*) is a first front perspective view of the cabinet surround illustrated in FIG. 4(*a*), looking into the drawer opening of the cabinet surround without the drawer inserted into the opening;

FIG. 6(*b*) is a plan view of the first side of the fifth example embodiment, depicted with the moveable member/body having been manipulated, such as for example by hand manipulation of the cloth layers that surround the body, to a corner portion of the fifth example embodiment so as to provide increased rigidity of that corner portion relative to other portions of the fifth example embodiment at which the member/body is not located.

DETAILED DESCRIPTION OF EXAMPLE EMBODIMENTS

Figure 1A:
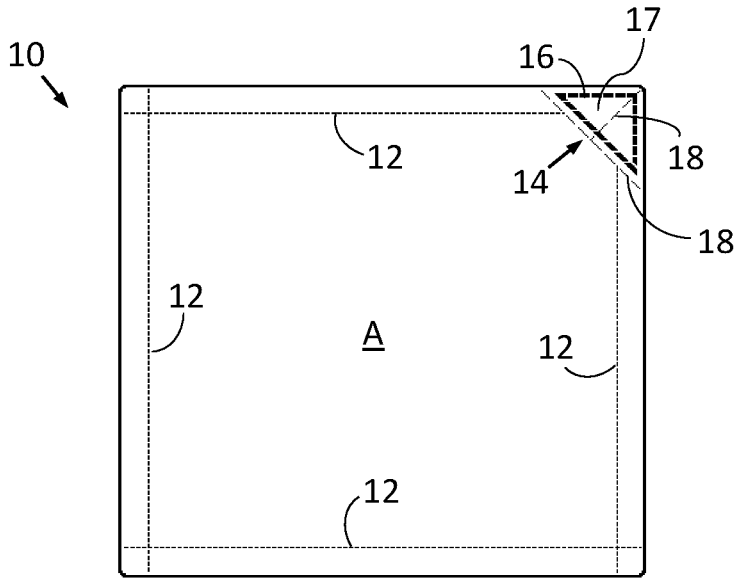
FIG. 1(*a*) is a plan view of a first side of a first example embodiment of the present invention.
Figure 1B:
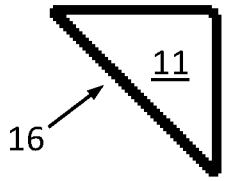
Figure 1C:
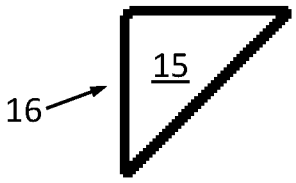
Figure 1D:
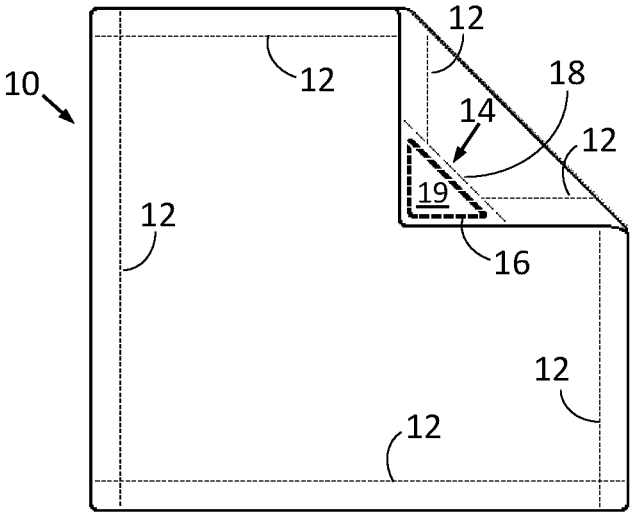
Figure 2A:
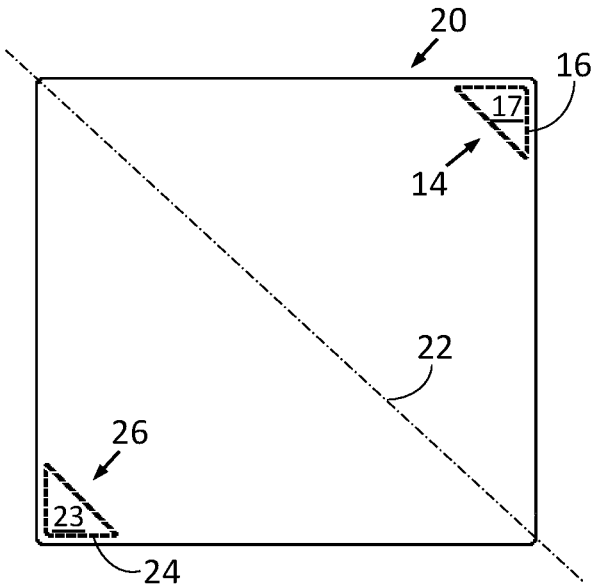
FIG. 2(*a*) is a plan view of a first side of a second example embodiment of the present invention.
Figure 2B:
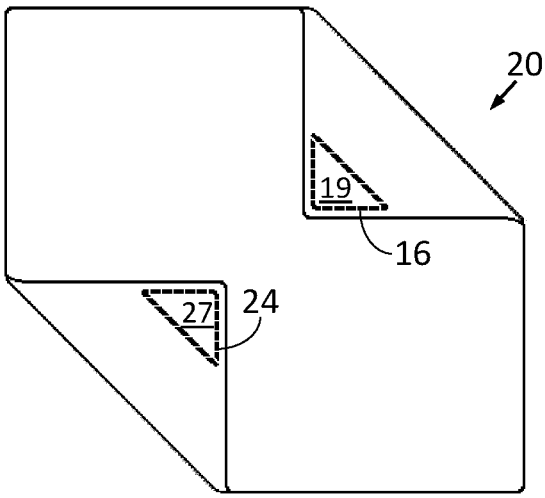
Figure 2C:
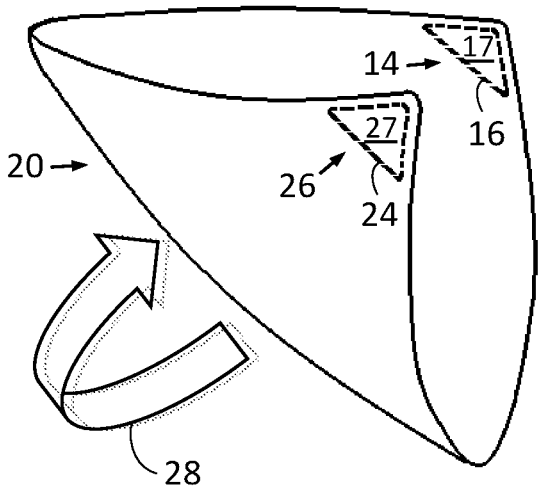
Figure 2D:
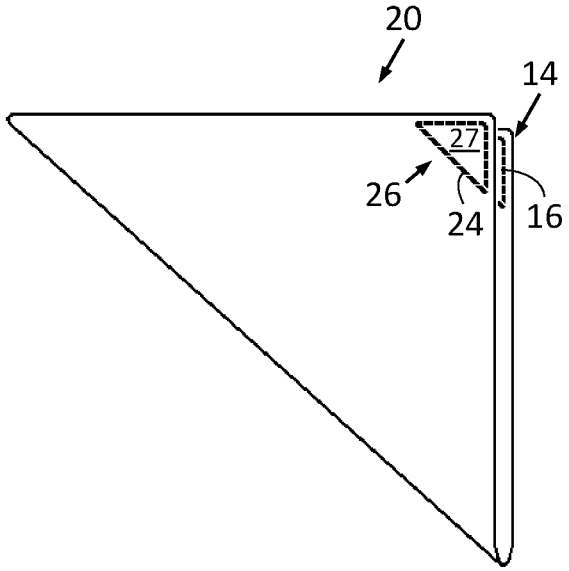

FIGS. 1 and 2 each depicts a cleaning cloth system according to an example embodiment of the present invention, as to other of the Figures. For easy reference, cleaning cloth systems shown and described herein may be alternatively referred to herein simply as cloths, or cleaning cloths. Those of skill in the art will understand and appreciate that cloths 10 and 20 can be used to clean open and accessible surfaces and areas in the same manner as traditional cleaning cloths that lack the added features and benefits of the present invention, because in addition to the various new features and benefits illustrated and described herein that aid in the cleaning of tight spots, narrow gaps, or other hard-to-reach surfaces and areas, relatively substantial portions of these example embodiment cloths 10 and 20 still maintain traditional cleaning cloth features known to those of skill in the art. In this way cloths 10 and 20 are multi-purpose cleaning cloths, in that they can be used not only to clean harder-to-reach surfaces and areas as described for example herein, but further they can also be used in traditional cleaning applications and methods, wherein for example the cloth is used as a whole to dust, wash, polish, or otherwise clean openly accessible table tops, counter tops or other easy-to-reach surfaces by hand. In view of the foregoing disclosure, those skilled in the art will thus understand and appreciate that example cloths 10 and 20 can be used for example in dry, and/or damp, and/or wet cleaning applications.

Those skilled in the art will readily understand and appreciate that cloths 10 and 20 can be each constructed from one or more layers and/or pieces of pliable cloth material selected from the array of cloth materials (herein also referred to generally as fabrics) already known to those of skill in the art as appropriate for use in household cleaning applications, such as for example cotton terry or microfiber. Those skilled in the art will also readily understand and appreciate that the present invention is not limited to a particular kind of cloth material (including, for example and without limitation, any particular textile composition, and/or textile structure including without limitation fiber structure), and that the cloth material used in the manufacture of a given cleaning cloth can be selected from an array of different pliable cloth materials, although the material chosen for a given cleaning cloth is preferably selected to be suitable for the intended cleaning application(s). Those skilled in the art will appreciate that cleaning cloths can be constructed for example from a single layer of material/fabric to form a single-ply cloth, or a plurality of layers to form a multi-ply cloth.

FIG. 1(*a*) depicts a plan view of example embodiment, singly-ply cloth 10. As shown by the Figures, those skilled in the art will understand that at least a majority if not the entirety of example cloth 10 is a substantially planar portion of pliable cloth material when laid flat, even though such planar portion of cloth 10 can be folded upon itself, such as is illustrated for example by FIG. 1(*d*), and/or can be otherwise manipulated into a non-planar form, such as for example when used in various cleaning applications, as is illustrated for example by FIG. 5. Stitching 12 serves to hem each of the four edges of cloth 10. Each broad side of cloth 10 shown in FIG. 1(*a*) has a total surface area A. Preferably a majority of surface area A, such as for example the entire surface areas A of cloth 10, that is except for corner portion 14 described below, is pliable so as to allow cloth 10 to be readily used in a conventional manner as a cleaning cloth in traditional cleaning applications. A relatively planar corner portion 14 of cloth 10 is adapted to be rigid. Rigid in this context of example embodiment cloth 10 does not necessarily dictate that corner portion 14 is not pliable or flexible to at least limited extent, but rather it means that corner portion 14 is at least less pliable and flexible relative to at least another meaningful portion and preferably a majority portion of the cloth 10 and surface area A, while also being at least inflexible enough to facilitate insertion of corner portion 14 into tight, narrow or otherwise hard-to-reach areas with relative ease for purposes of cleaning such areas. If desired, however, the rigidity of corner portion 14 alternatively could be formed to be substantially if not entirely inflexible relative to another portion of the cloth, so as to in turn render corner portion 14 substantially or entirely inflexible.

For cloth 10, corner portion 14 is the triangular-shaped corner of cloth 10 defined by the two edges of cloth 10 at its corner and, at the base of such triangular shape, by stitching 18. For the avoidance of doubt, however, it will be understood that smaller portions of corner portion 14 nevertheless still do represent the corner of cloth 10. In other words, the term corner, as used herein, does not necessarily refer to a corner region of cloth 10 that encompasses all of corner portion 14. In this way, the particular point at which the two edges of cloth 10 converge together is still properly referred to herein as a corner of cloth 10, without such reference necessarily also including the remaining portions of the triangular region referred to above as corner portion 14.

Figure 5:
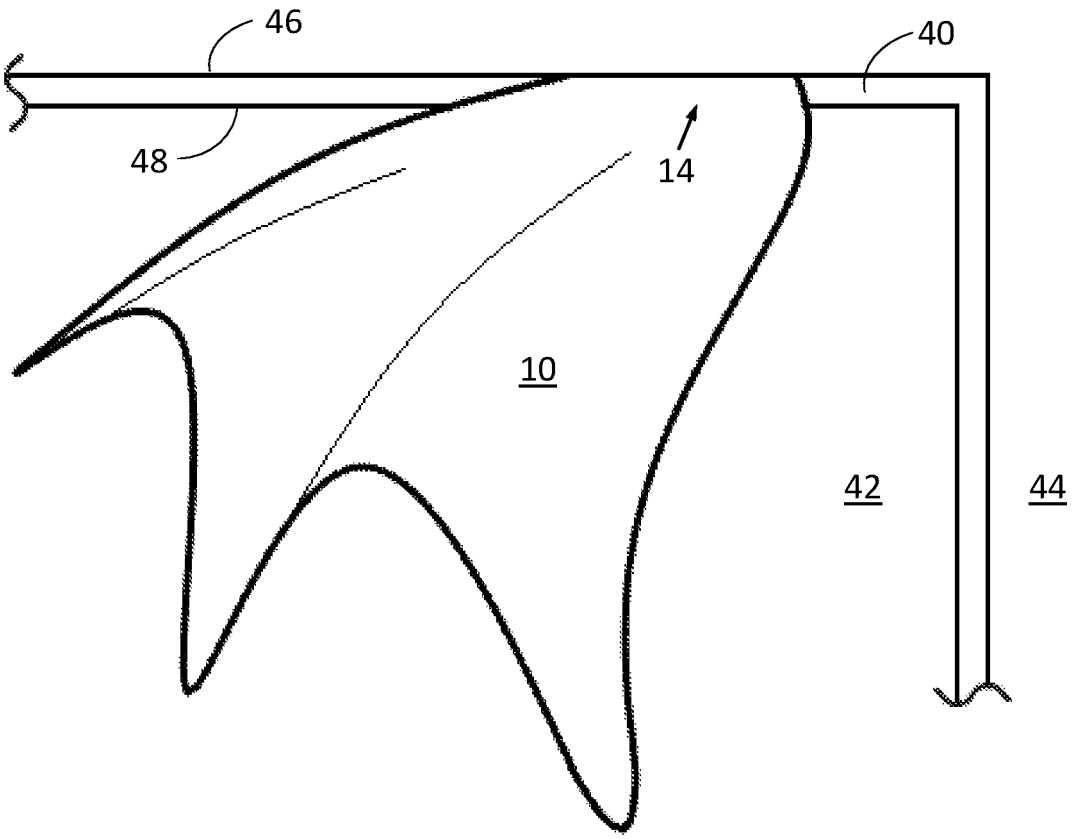
FIG. 5 is a second depiction of what is illustrated in FIG. 4(*b*), this time depicted to illustrate the insertion of an embodiment of the present invention into a gap between the cabinet surround and the cooperating inset drawer face.

With its increased rigidity, such corner portion 14 is adapted for example to be more readily inserted into, and accordingly used to dust or otherwise clean, tight, narrow or small spaces as shown for example in FIG. 5, that is as compared to at least another portion of cloth 10. While being so used to clean difficult-to-reach areas, the relative rigidity of corner portion 14 of cloth 10 serves to substantially maintain the corner portion's relatively planar shape in this example embodiment, which in turn facilitates such dusting or other cleaning, as illustrated for example in FIG. 5.

FIG. 5 illustrates an example of cleaning within a tight, narrow or small space, such as for example with reference to FIG. 4, the surrounding gap 40 within drawer opening 45 between a closed-position inset cabinet drawer face 42 and adjacent cabinet face 44. In this particular example, when cabinet drawer 47 is in a closed position, corner portion 14 of cloth 10 can be readily inserted into and controlled within gap 40 so as to clean difficult-to-reach surfaces within gap 40, such as the edge surface 46 of the cabinet surround 44 that sits within and on one side of gap 40 adjacent to and on the opposite side of gap 40 from edge surface 48 of inset cabinet drawer face 42. When for example corner portion 14 of cloth 10 is inserted into and slid along or otherwise moved within the length of gap 40, preferably the cloth of a first side 17 of corner portion 14 wipes, and thereby cleans, edge surface 46 while at the same time the cloth of opposite side 19 of corner portion 14 wipes, and thereby cleans, edge surface 48, provided that the width between surfaces 46 and 48 isn't substantially greater than the thickness of corner portion 14. Other examples of such tight or small spaces include, by way of example and without limitation, the interior surfaces and/or spaces within narrow gaps or openings between adjacent structures, such as for example the keys of a keyboard or the multiple slotted openings in a residential HVAC wall or floor vent. In addition, corner portion 14 also facilitates cleaning even in other hard-to-reach areas having an opening or space between surfaces that is wider than the thickness of corner portion 14. For convenience, tight, or narrow, or otherwise small or difficult-to-reach surfaces, spots and/or spaces of all kinds are herein referred to generically as tight locations.

As is evident from the above example, the present invention further includes a method for cleaning one or more surfaces within an opening, such as for example between two adjacent structures, the method comprising inserting a portion of a cleaning cloth into the opening and moving the portion of the cleaning cloth within the opening to wipe at least one surface disposed within the opening. The cloth which is used in this manner can be for example any one or more of the example embodiment cloths described herein, although the present invention is not limited to these particular embodiments. In the circumstance of the example embodiment cloths described herein, the portion of the cloth inserted into such opening could be any one or more of corners 14, 26 and 68, just for example, including overlapping corners as is described further herein.

It will be apparent to those skilled in the art that the closer the unit of measure, at a given location of an opening, or gap, or separation (all of the foregoing of which are referred to herein as an opening for convenience), between two adjacent structures (that together form the opening, or gap, or separation, or width, at that particular location) is to the thickness of that portion of the cleaning cloth inserted into the opening, and in particular that particular inserted portion that is more rigid relative to other significant portions of the cleaning cloth, the easier and more effective it is to simultaneously wipe multiple surfaces within the opening upon each movement, or stroke, of the cloth within the opening.

In this sort of an example application, the present invention can be more efficient in cleaning if for example the width of the opening, into which the cleaning cloth is inserted for cleaning within the opening, is less than ten times (10×) the thickness of the inserted, more rigid cloth portion, as opposed to more than ten times the thickness of the portion. Similarly, the present invention can be more efficient in cleaning if for example the width of the opening, into which the cleaning cloth is inserted for cleaning within the opening, is less than five times (5×) the thickness of the inserted, more rigid cloth portion, as opposed to more than five times the thickness of the portion. Indeed, taking these examples even further, the present invention can be very effective and efficient in cleaning if for example the width of the opening, into which the cleaning cloth is inserted for cleaning within the opening, closely approximates thickness of the inserted, more rigid cloth portion—whether such portion comprises one or more stacked layers of cleaning cloth and one or more bodies, such that for a given stroke of the cleaning cloth portion within the opening, opposite sides of the cleaning cloth portion inserted into the opening, such as for example opposing sides 17 and 19, each simultaneously wipe a respective surface of, for example, two opposing structures that may define the width of the opening. In that same stroke the cleaning cloth portion also has the opportunity to clean the space between the two surfaces. Nevertheless, the present invention does not necessarily require that all surfaces within the opening be wiped simultaneously with a same movement, or stroke, of the cleaning cloth.

For cloth 10 show by FIG. 1, the rigidity of corner portion 14 is preferably provided by a member 16, the isolated structure of which is illustrated in FIGS. 1(*b*) and 1(*c*), which in turn is preferably a thin triangular-shaped structure, such as for example a thin triangular-shaped piece of plastic, that is sufficiently stiff to provide the desired rigidity to form corner portion 14 when secured in place in the fabric. As is evident by the Figures, illustrated member 16 is an example body that is at least substantially planar and has a first side 11 and a second side 15 opposite side 11, and this body 16 is disposed and retained by cloth 10 in a substantially parallel-planar relationship relative to the fabric of cloth 10 along an edge of cloth 10, and in particular where two edges of the cloth 10 meet to form a corner portion 14. It is also evident that for example cloth 10, body 16 is smaller in surface area relative to the surface area of the fabric of cloth 10. For example cloth 10, it will be understood that in this example member 16 is a body that is distinct from the fabric but is nevertheless sewn into the hem at one corner of cloth 10 to form corner portion 14. In particular, the fabric of cloth 10 is folded over member 16 and sewn at stitching 18 so as to secure member 16 in place at the corner of cloth 10. As a result, the fabric of cloth 10 covers member 16 on both sides 11 and 15 when member 16 is in place, which in turn enables the fabric of each opposing side 17 and 19 of corner portion 14 to be used as a cleaning surface. From this foregoing disclosure, those skilled in the art will understand and appreciate that corner portion 14 of example cloth 10 is more rigid as a result of the presence of the body 16, relative to another substantial portion of cloth 10 at which the substantially planar body is not located—such as for example the remaining portion of surface area A of cloth 10. In this way the fabric of opposing sides 17 and 19 of the more rigid corner portion 14 can be used, in suitable applications, to clean opposing surfaces within a given gap, perhaps even simultaneously depending upon the width of the gap.

Instead of a triangular-shaped piece of stiff plastic, member or body 16 could comprise an alternative material such as for example a layer of metal, cardboard, sponge, or foam such as Styrofoam or polystyrene, and/or body 16 could take a different shape such as for example a circle, square, or rectangle, just to name a few. It could also take the form of a more three-dimensional object, such as for example a cube or a sphere, just to name a couple examples. Moreover, those skilled in the art will understand and appreciate that body 16 instead could comprise a collection of smaller objects, such as for example and without limitation a collection of sand or pellets that, as a collection, forms a body that serves to enhance the rigidity of corner portion 14, for example, relative to other portions of the cloth. The interchangeable terms member and body, as used herein, are not intended to be uniquely defined and/or limited by this disclosure. Instead, those skilled in the art will understand the term body to be a term of art that is not limited by the example embodiments disclosed and described herein.

Alternatively the relative rigidity of corner portion of cloth 10 could be formed by introducing a substance onto or into the fabric of the cloth itself, such as for example and without limitation a liquid or gel form of adhesive, that through passage of time, application of heat, or through other means, imparts a stiffness to the fabric so as to add relative rigidity to a portion of the cloth to form corner portion 14, thus in turn obviating for example body 16 and associated stitching 18.

FIG. 2 depicts another example embodiment of the invention, wherein the characteristics of cloth 20 are consistent with the above-described characteristics of cloth 10, including without limitation the inclusion of corner portion 14, but in this example embodiment rectangular-shaped cloth 20 has a second corner portion 26 at a corner of cloth 20 that is same as but opposite corner portion 14. Here, corner portion 26 is formed using body 24, which is the same as body 16. As a result, corner portion 26 has a first side 23 and a second opposing side 27. Side 23 of corner portion 26 is on the same side first side of cloth 20 as is side 17 of corner portion 14. Similarly, as perhaps best shown by FIG. 2(*b*), side 27 of corner portion 26 is on the same second side of cloth 20 as is side 19 of corner portion 14. Stitching 12 and 18 shown in FIG. 1 is not similarly depicted in FIG. 2 with respect to cloth 20, in an effort to ensure clarity as to the remaining illustrated characteristics of cloth 20. FIG. 2(*b*) depicts cloth 20 partially folded over upon itself, in an effort to at least partially illustrate the reverse, or second, side of cloth 20 relative to that which is shown in FIG. 1.

Alternatively, of course, cloth 20 could be formed without stitching similar to the stitching 12 and 18 depicted in FIG.

1. For example, cloth 20 could be a two-ply cloth wherein the two plies are affixed to one another at or immediately adjacent their outermost edges using stitching, or glue. In the absence of a stitch similar to stitch 18 of FIG. 1, a member such as member 16 and/or member 24 instead could be held in place between the plies in a corner of the cloth by a glue, for example.

As shown by FIGS. 2(*c*) and 2(*d*), use of cloth 20 can include in part folding cloth 20 over upon itself, for example along line 22 shown in FIG. 2(*a*) and as illustrated by folding step and direction 28 shown in FIG. 2(*c*), to bring corner portion 26 into an overlapping relationship with corner portion 14 wherein side 23 of corner portion 26 meets side 17 of corner portion 14, as shown for example by FIG. 2(*d*). This in effect doubles the thickness of the cloth for use, for example, to better clean within gaps having widths that are wider than the thickness of the cloth. Cloth 20 may be further adapted to at least bias such corners 14 and 26 to maintain such overlapping relationship once so placed, by for example forming each of bodies 16 and 24 from a magnetic material having a magnetic polarity that is opposite the polarity of the other of the two structural bodies. In this example, once the various areas within a given gap or space have been cleaned using corner portions 14 and 26, the bias provided by bodies 16 and 24 can be overcome by manually pulling the two corner portions 14 and 26 apart, after which cloth 20 as a whole can again be used for traditional cleaning applications and methods, or to allow for use of just one of the two corner portions 14 and 26 to reach those tight locations for which overlapping corners would be too thick. Those skilled in the art will understand from this disclosure that other means of biasing or fixing such corners 14 and 26 to maintain such overlapping relationship could instead be used, such as for example cooperating Velcro strips or the arrangement illustrated below for example by FIG. 3(*a*).

Figure 3A:
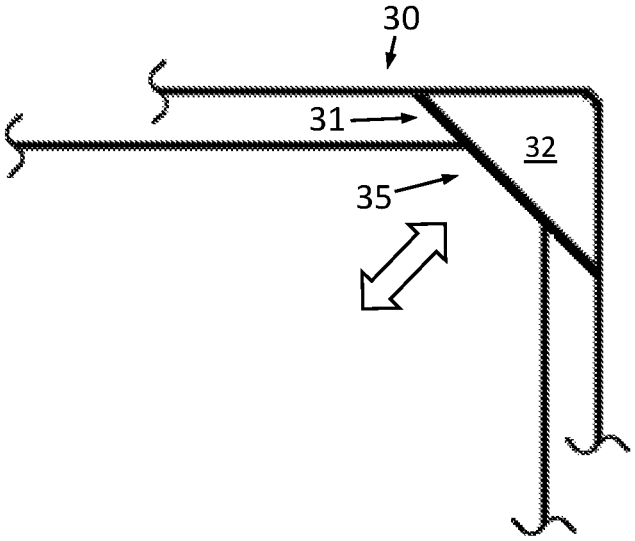
FIG. 3(*a*) is a partial view of a folded third example embodiment of the present invention, depicting two opposing corner portions wherein one of the two opposing corner portions is selectively and removably tucked or received into a pocket located at the second of the two opposing corner portions.
Figure 3B:
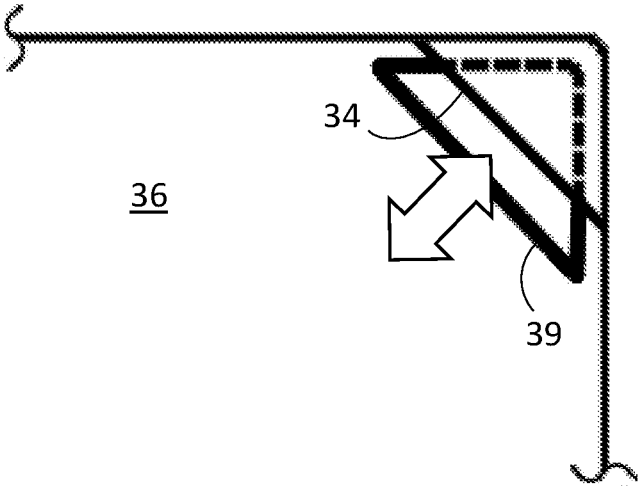
Figure 4A:
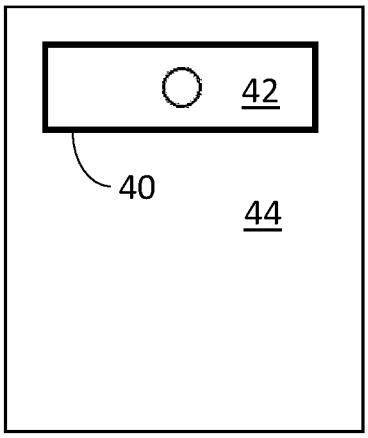
FIG. 4(*a*) illustrates a front view of an example inset drawer face placed within a drawer opening of an example cabinet surround or face.
Figure 4B:
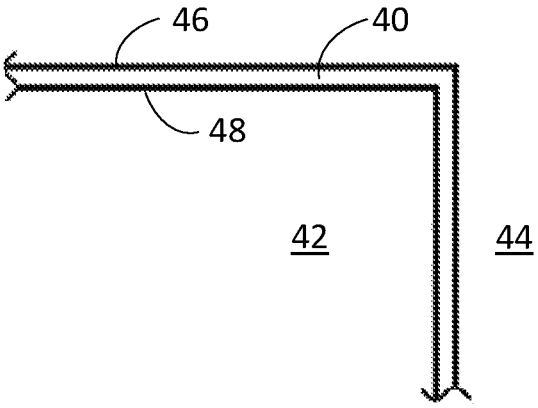
Figure 4C:
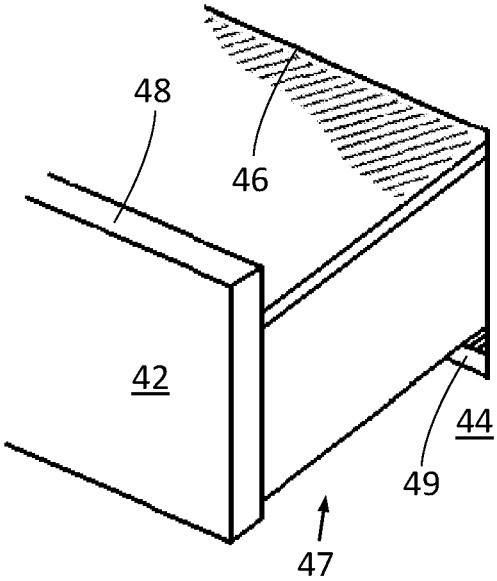
Figure 4D:
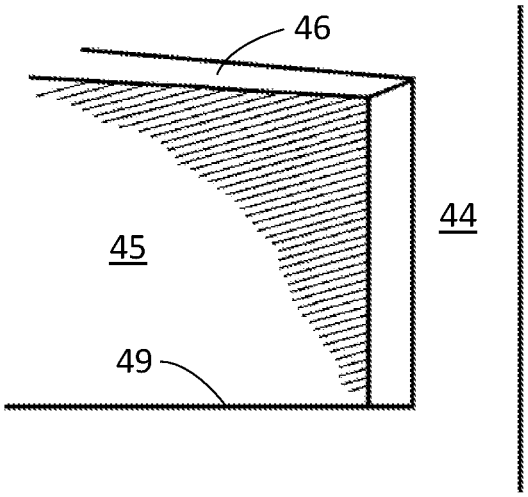

FIG. 3(*a*) depicts a cloth 30 that is like cloth 20 in all respects, except that cloth 30 includes an added corner pocket 32 overlaying what is side 17 of corner portion 14 of cloth 20, wherein corner pocket 32 is formed by the same fabric as the remainder of cloth 30 and includes a pocket opening 31 into which the second, overlapping corner portion 35 (similar to corner portion 26 of cloth 20) can be selectively and removably tucked or received so as to maintain an overlapping relationship of the two corners. The remaining two edges of corner pocket 32 are stitched or otherwise closed along the respective outer edges of cloth 30 so as to form a pocket that serves to maintain in place an overlapping relation of corner portions.

The corner pocket 34 illustrated in FIG. 3(*b*) belongs to yet another example cloth, cloth 36, and the pocket itself is similar in construction to corner pocket 32 shown in FIG. 3(*a*). Except in this example embodiment, the illustrated corner of cloth 36 is a rigid corner portion 38 of cloth 36 only when body 39 is selectively and removably inserted into corner pocket 34. In this way, body 39 is not permanently placed into a corner of cloth 36, as body 16 of cloth 10 is permanently placed in corner portion 14. Instead, body or member 39 is a piece that is entirely separable from the cloth and which can be selectively inserted into corner pocket 34 on those particular occasions when the cloth user seeks a rigid corner portion to clean the kinds of tight locations described above for example. Yet at other times, and for other types of cleaning applications, member 39 can be easily removed from corner pocket 34 and set aside apart from the remainder of the cloth, to the extent that the benefits of rigid corner portion 38 are not necessary or desired.

Figure 6A:
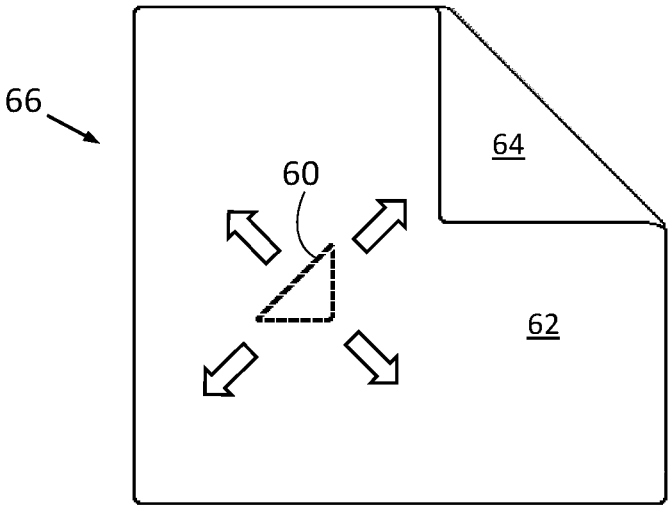
FIG. 6(*a*) is a plan view of a first side of a fifth example embodiment that includes a moveable member/body, with one corner portion of the example embodiment folded over onto a remaining portion of the example embodiment so as to reveal in part a second, opposite side of the fifth example embodiment.
Figure 6B:
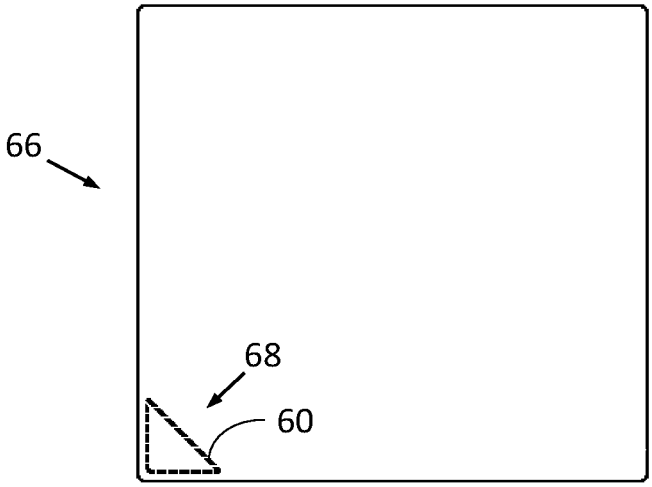

In yet another alternative embodiment, a body like member 16 is not permanently affixed to a corner portion of a cloth, whether by stitch or glue or otherwise, or selectively separable as described immediately above. Instead, the body is maintained between, and relatively free to move, or float, within at least a range of motion between, two plies of a cloth having at least two plies that are affixed together at their edges. In this way, the cloth can be used for example as a whole in a first manner as a cleaning cloth in traditional cleaning applications, without necessarily presenting a rigid corner portion, because the body is relatively free to move between the two plies and locate itself between these plies in other than a corner portion. Alternatively that same cloth can be used in a second manner to clean more difficult-to-reach areas, which is accomplished for example by manipulating by hand the exterior of the cloth so as to in turn manipulate the more rigid body disposed and contained within and between the cloth's plies, such that the body as a result is selectively moved to and maintained at a corner portion of the cloth to facilitate cleaning of the hard-to-reach area with such corner portion. FIGS. 6(*a*) and 6(*b*) illustrate such an example embodiment, wherein 6(*a*) illustrates the relative freedom member 60 has between the two plies 62 and 64 of cloth 66. FIG. 6(*b*) illustrates the result of manipulating member 60 to selectively form rigid corner portion 68 of cloth 66.

From the Figures and foregoing description, it will be understood and appreciated by those skilled in the art that the example embodiments of the present invention disclosed herein relate to a cleaning cloth and cleaning cloth system. The example embodiment cleaning cloths each have at least a first layer of pliable cloth material, and a body that is smaller in surface area and more rigid than the first layer of pliable cloth material. The surface area of the body could be substantially smaller than the surface area of the first layer of pliable cloth material; which, in the context of each of the example bodies illustrated in the Figures, is significantly less than half. The increased rigidity of the body relative to the first layer of pliable cloth material could be substantial, and the increased rigidity is, at minimum, more than an insubstantial amount not readily discernable through a side-by-side comparison. In this regard, the preferred increased rigidity is of a sufficient amount to enable the body, and in turn the cleaning cloth and cleaning cloth system, to readily enter and move through a variety of example tight spaces without easily buckling in a manner as would one, two, or even a few, layers of pliable cloth material by itself without any additional support. The cleaning cloths of the disclosed embodiments are adapted to retain the body adjacent the first layer of pliable cloth material.

The example bodies depicted and described herein are each a substantially planar body, although as mentioned above the invention is not so limited. At least FIGS. 1 and 2 contemplate that such substantially planar body is permanently retained by the cleaning cloth at a corner of the cleaning cloth, such as for example by sewing the body into a hem of the pliable cloth material. At least FIGS. 2 and 3 further contemplate not only a first corner, but also a second corner of the cleaning cloth, wherein at least one of the first corner and the second corner is adapted to engage the other of the first corner and the second corner to removably hold the first corner in a layered relationship relative to and adjacent the second corner when the first corner is placed proximate the second corner. In these examples, a substantially planar body may be retained by the cleaning cloth in at least one of the first and second corners, if not in each of the first and second corners. The corners may engage one another for example by way of a magnetic attraction between these two corners, or through the use of a pocket at one of the two corners that removably receives and retains the other of these two corners. With respect to magnetic attraction, preferably at least one of the two substantially planar bodies is magnetically attracted to the other, and such magnetic attraction is preferably sufficient to removably hold the first corner in a layered relationship relative to and adjacent the second corner when the first corner is placed proximate the second corner. In this way the two corners can remain layered while cleaning a tight space that benefits from the increased thickness of the cleaning cloth provided by the layered corners, but the corners can thereafter be readily separated from one another through hand manipulation so as to overcome the magnetic attraction. Other means of engagement are also possible, as will be understood by those of skill in the art.

FIG. 6 discloses an example embodiment wherein the cleaning cloth further comprises a second layer of pliable cloth material that together with the first layer of pliable cloth material forms a closed space between the first layer of pliable cloth material and the second layer of pliable cloth material, and wherein the closed space is adapted to both confine the body within the closed space and permit the body to be selectively moved within the closed space from a first portion of the cleaning cloth to a plurality of other portions of the cleaning cloth, and wherein one of the plurality of other portions of the cleaning cloth includes at least in part a portion of the cleaning cloth adjacent an edge of the cleaning cloth.

Also disclosed herein are methods for cleaning, including for example cleaning within an opening between two adjacent structures. The example steps include, with reference to FIGS. 4 and 5 in particular, as well as the other Figures and the foregoing description, inserting a portion of a cleaning cloth system into the opening and moving the portion of the cleaning cloth system within the opening to clean within the opening. In this example, the cleaning cloth system comprises a cleaning cloth having at least a first layer of pliable cloth material, and a body retained by the cleaning cloth. The body in each of these disclosed example embodiments is preferably both smaller in surface area and semi-rigid, at least relative to the first layer of pliable cloth material. At least while the portion of the cleaning cloth system is moved within the opening to clean within the opening, the body is disposed at the portion of the cleaning cloth system and disposed both adjacent to the first layer of pliable cloth material and at least in part within the opening. As a result, these example embodiment cleaning cloths and cleaning cloth systems are adapted to readily enter and move through a variety of example tight spaces without easily buckling in a manner as would one, two, or even a few, layers of pliable cloth material by itself without any additional support.

The pertinent portion of the example cleaning cloths and cleaning cloth systems shown for example in FIGS. 1, 2, 3 and 6(*b*), that in particular is used in this example method to clean within the openings, is preferably a location on the cleaning cloth adjacent at least one edge of the cleaning cloth, and wherein the body is a substantially planar body disposed adjacent to and substantially parallel-planar with the first layer of pliable cloth material. Indeed, the substantially planar body can even be for example permanently (e.g., FIG. 1), if not moveably (e.g., FIG. 6) or removably (e.g., without limitation FIG. 3(*b*)), retained by the cleaning cloth at a location on the cleaning cloth adjacent at least one edge of the cleaning cloth. In each of these particular example, the location adjacent at least one edge happens to be at a corner of the cleaning cloth, which is a location on the cleaning cloth where one edge of the cleaning cloth converges with another edge of the cleaning cloth to form a corner.

With respect to an example method for cleaning in which the example cleaning cloth and cleaning cloth system of FIG. 2 are used, the portion of the cleaning cloth system used to clean within the openings comprises a first corner, and a second corner disposed in a layered relationship relative to the first corner, and at least a portion of a first body (retained by one of the first and second corners of the cleaning cloth) in a layered relationship relative to each of the first corner and second corner; and at least a portion of a second body (retained by the other of first and second corners of the cleaning cloth) in a layered relationship relative to each of the first corner, the second corner, and the first body. Each of these two bodies for example can be a substantially planar body, and the spatial relationship between these two bodies in this context can be for example a substantially parallel-planar relationship.

In the foregoing description, the invention is described with reference to specific example embodiments thereof. It will, however, be evident that various modifications and changes may be made thereto, without departing from the broader spirit and scope of the present invention. The specification and drawings are accordingly to be regarded in an illustrative rather than in a restrictive sense.

What is claimed is:

1. A method for cleaning within an opening between two adjacent structures, comprising:

inserting a first portion of a cleaning cloth system at least in part into the opening; and moving the inserted first portion of the cleaning cloth system within the opening to clean within the opening;

wherein the cleaning cloth system is configured to be held by hand while cleaning within the opening, and comprises:

a cleaning cloth established by a first layer of pliable cloth material, the cleaning cloth comprising a first cloth portion, and a second cloth portion that is the entirety of the cleaning cloth other than the first cloth portion, wherein a planar surface area of an entirety of the second cloth portion is substantially larger than a planar surface area of an entirety of the first cloth portion; and a body having a rigidity relative to the first layer of pliable cloth material;

wherein the cleaning cloth system further comprises, at least while the inserted first portion of the cleaning cloth system is moved within the opening to clean within the opening:

the first portion of the cleaning cloth system, the first portion of the cleaning cloth system comprising the first cloth portion and the body, wherein the body is retained by the first cloth portion and establishes a rigidity of the first portion of the cleaning cloth system; and a second portion of the cleaning cloth system comprising an entirety of the cleaning cloth system other than the first portion of the cleaning cloth system, wherein the second portion of the cleaning cloth system comprises the second cloth portion, and wherein at least a substantial majority of the second portion of the cleaning cloth system is pliable and lacks the rigidity of the first portion of the cleaning cloth system.

2. The method for cleaning of claim 1, wherein the body is a substantially planar body.

3. The method for cleaning of claim 1, wherein the first portion of the cleaning cloth system comprises a portion of the cleaning cloth adjacent at least one edge of the cleaning cloth, and wherein the body is a substantially planar body disposed adjacent to the first layer of pliable cloth material.

4. The method for cleaning of claim 3, wherein the substantially planar body is permanently retained by the cleaning cloth at the location on the cleaning cloth adjacent at least one edge of the cleaning cloth.

5. The method for cleaning of claim 3, wherein the substantially planar body is retained by the cleaning cloth at the location on the cleaning cloth adjacent at least one edge of the cleaning cloth.

6. The method for cleaning of claim 5, wherein the at least one edge of the cleaning cloth converges with another edge of the cleaning cloth to form a corner of the cleaning cloth, and wherein the substantially planar body is retained by the cleaning cloth at the corner of the cleaning cloth.

7. The method for cleaning of claim 6, wherein the substantially planar body is removably received into and retained by a pocket that is both formed at the corner of the cleaning cloth and configured to removably receive and retain the substantially planar body.

8. The method for cleaning of claim 1, wherein the body is removably received into a pocket formed at least in part adjacent at least one edge of the cleaning cloth.

9. The method for cleaning of claim 1, wherein the cleaning cloth is shaped to comprise at least a first corner and a second corner spaced away from the first corner, and wherein the body is a first body disposed at the first corner, and wherein the cleaning cloth system further comprises a second body disposed at the second corner.

10. The method for cleaning of claim 9, wherein the first portion of the cleaning cloth system comprises:

the first corner;

the second corner disposed in a layered relationship relative to the first corner;

at least a portion of the first body in a layered relationship relative to each of at least a portion of the first corner, at least a portion of second corner, and at least a portion of the second body.

11. The method for cleaning of claim 10, wherein the first body is a first substantially planar body, and wherein the second body is a second substantially planar body.

12. The method for cleaning of claim 11, wherein at least one of the first substantially planar body and the second substantially planar body is magnetically attracted to the other of the first substantially planar body and the second substantially planar body, the magnetic attraction being sufficient to removably hold the second corner in the layered relationship relative to the first corner.

13. The method for cleaning of claim 1, wherein the cleaning cloth is shaped to comprise at least a first corner and a second corner, and wherein the body is a substantially planar body disposed at the first corner, and wherein the cleaning cloth further comprises a pocket at the second corner configured to removably receive the first corner and at least a portion of the substantially planar body.

14. The method for cleaning of claim 1, wherein the cleaning cloth further comprises a second layer of pliable cloth material that together with the first layer of pliable cloth material forms a closed space between the first layer of pliable cloth material and the second layer of pliable cloth material, and wherein the closed space is configured to both confine the body within the closed space and permit the body to be selectively moved within the closed space from a first location within the closed space to a plurality of other locations within the closed space, and wherein one of the plurality of other locations within the closed space includes at least in part a location within the closed space adjacent an edge of the cleaning cloth.

15. A method for cleaning within an opening between two adjacent structures, comprising:

inserting a first portion of a cleaning cloth system at least in part into the opening; and moving the inserted first portion of the cleaning cloth system within the opening to clean within the opening;

wherein the cleaning cloth system is configured to be held by hand while cleaning within the opening, and comprises:

a cleaning cloth established by a first layer of pliable cloth material, the cleaning cloth comprising a first cloth portion, and a second cloth portion that is the entirety of the cleaning cloth other than the first cloth portion, wherein a planar surface area of an entirety of the second cloth portion is substantially larger than a planar surface area of an entirety of the first cloth portion; and a body having a rigidity relative to the first layer of pliable cloth material;

wherein the cleaning cloth is configured to at least one of:

permanently retain the body;

removably retain the body;

wherein the cleaning cloth system further comprises, at least while the inserted first portion of the cleaning cloth system is moved within the opening to clean within the opening:

the first portion of the cleaning cloth system, the first portion of the cleaning cloth system comprising the first cloth portion and the body, wherein the body is retained by the first cloth portion and establishes a rigidity of the first portion of the cleaning cloth system; and a second portion of the cleaning cloth system comprising an entirety of the cleaning cloth system other than the first portion of the cleaning cloth system, wherein the second portion of the cleaning cloth system comprises the second cloth portion, and wherein at least a substantial majority of the second portion of the cleaning cloth system is pliable and lacks the rigidity of the first portion of the cleaning cloth system.

16. The method for cleaning of claim 15, wherein the first portion of the cleaning cloth system further comprises a corner of the cleaning cloth, and wherein the body is a substantially planar body permanently retained by the cleaning cloth, and wherein the substantially planar body is, at least while the inserted first portion of the cleaning cloth system is moved within the opening to clean within the opening, disposed at the corner of the cleaning cloth adjacent to the first layer of pliable cloth material.

17. The method for cleaning of claim 1, wherein the first cloth portion is configured to removably retain the body.

18. The method for cleaning of claim 1, wherein the first cloth portion is configured to permanently retain the body.

19. The method for claiming of claim 1, wherein the second cloth portion is configured to also at least one of:

permanently retain the body; and removably retain the body.

20. The method for cleaning of claim 1, wherein the second portion of the cleaning cloth system at least in part does not extend into the opening while the inserted first portion of the cleaning cloth system is moved within the opening to clean within the opening.

* * * * *